US008627620B2

(12) United States Patent
Sanchez

(10) Patent No.: US 8,627,620 B2
(45) **Date of Patent: *Jan. 14, 2014**

(54) MODULAR CONSTRUCTION SYSTEM

(75) Inventor: Roberto Edmundo Pazmino Sanchez, Guayaquil (EC)

(73) Assignee: MOPREC S.A., Guayaquil (EC)

( * ) Notice: Subject to any disclaimer, the term of this patent is extended or adjusted under 35 U.S.C. 154(b) by 0 days.

This patent is subject to a terminal disclaimer.

(21) Appl. No.: 13/556,111

(22) Filed: Jul. 23, 2012

(65) Prior Publication Data

US 2012/0285113 A1 Nov. 15, 2012

Related U.S. Application Data

(63) Continuation of application No. 10/764,194, filed on Jan. 23, 2004, now Pat. No. 8,225,564.

(51) Int. Cl.
*E04C 5/08* (2006.01)
*E04B 1/00* (2006.01)

(52) U.S. Cl.
USPC ..... 52/223.7; 52/258; 52/583.1; 52/604

(58) Field of Classification Search
USPC ..... 52/223.6, 223.7, 250, 258, 578, 583.1, 52/596, 599, 604, 792.1, 630, 251, 259, 52/236.8
See application file for complete search history.

(56) References Cited

U.S. PATENT DOCUMENTS

| | | | | |
|---|---|---|---|---|
| 1,113,268 | A | | 10/1914 | Watson |
| 1,433,219 | A | * | 10/1922 | Newell ..... 52/583.1 |
| 2,043,697 | A | | 6/1936 | Deichmann |
| 2,642,415 | A | | 2/1949 | Nagel |
| 3,475,529 | A | * | 10/1969 | Lacy |
| 3,555,763 | A | | 1/1971 | Bloxom |
| 3,613,325 | A | | 10/1971 | Vee |
| 3,747,287 | A | | 7/1973 | Finger |
| 3,918,222 | A | | 11/1975 | Bahramian |
| 4,142,339 | A | | 3/1979 | Crowley |
| 4,158,941 | A | | 6/1979 | Diana |
| 4,320,606 | A | | 3/1982 | GangaRao |
| 4,372,092 | A | | 2/1983 | Lopez |
| 4,676,035 | A | | 6/1987 | GangaRao |
| 4,781,492 | A | | 11/1988 | Shindo |
| 4,864,794 | A | * | 9/1989 | Scourtelis ..... 52/584.1 |
| 4,930,677 | A | | 6/1990 | Jolliffee |
| 5,072,556 | A | | 12/1991 | Egenhoefer |
| 5,285,607 | A | | 2/1994 | Somerville |
| 5,484,235 | A | | 1/1996 | Hilfiker et al. |
| 5,649,391 | A | | 7/1997 | Layne |
| 5,671,582 | A | | 9/1997 | Reay |
| 5,678,372 | A | * | 10/1997 | Thomson et al. ..... 52/432 |
| 5,743,056 | A | | 4/1998 | Balla-Goddard et al. |
| 5,806,273 | A | | 9/1998 | Kaminski et al. |
| 5,809,732 | A | | 9/1998 | Farmer, Sr. |
| 5,881,524 | A | | 3/1999 | Ellison, Jr. |
| 5,921,710 | A | | 7/1999 | Scales |
| 6,065,263 | A | * | 5/2000 | Taguchi ..... 52/583.1 |
| 6,314,696 | B2 | | 11/2001 | Fust, III |
| 6,508,607 | B1 | | 1/2003 | Smith et al. |
| RE37,981 | E | | 2/2003 | Layne |
| 7,121,061 | B2 | | 10/2006 | Jazzar |

* cited by examiner

*Primary Examiner* — Jessica Laux
(74) *Attorney, Agent, or Firm* — Knobbe Martens Olson & Bear, LLP

(57) ABSTRACT

The present invention provides a novel modular building system exhibiting superior strength to withstand seismic activity.

12 Claims, 5 Drawing Sheets

FORCED VIBRATIONE TEST

MODULAR CONSTRUCTION SYSTEM

CROSS-REFERENCE TO RELATED APPLICATIONS

This application is a continuation application of U.S. application Ser. No. 10/764,194 filed on Jan. 23, 2004 and titled MODULAR CONSTRUCTION SYSTEM, the entire contents of which are hereby incorporated by reference and should be considered a part of this specification.

BACKGROUND

1. Field

The present invention relates to the field of building materials and, more specifically, to the field of a concrete modular building system of superior strength.

2. Description of the Related Art

Modular building systems exist in the prior art. U.S. Pat. No. 2,462,415 to Nagel teaches building and wall construction using preformed units. Unlike the present invention, Nagel utilizes a metallic peripheral frame (col. 2, lines 14-15) to secure the preformed units together. Similarly, U.S. Pat. No. 3,555,763 to Bloxom teaches a method of forming walls with prefabricated panels with metallic peripheral frames. The metal frames of Nagel and Bloxom add to the cost of construction because of the amount of metal required to create a frame of sufficient strength to support the panel. Assembly of structures using Bloxom's panels is not easy because it requires the use of a crane at the construction site to place them, thereby negating any savings produced by the use of modular components. Bloxom's panels require welding of the entire seam to join them together. Welding the entire seam is time-consuming and subject to human error. In Nagel, adjacent panels are interlocked by the metallic frame. Any errors in the size, shape or location of the interlock, which comprises the entire length of the panel, will cause the panel to fail to fit in its proper location U.S. Pat. No. 4,320,606 to GangaRao also teaches buildings formed by assembling a multiplicity of pre-cast reinforced concrete panels. Similar to Bloxom, GangaRao welds metal bars of adjacent panels to connect his panels, a time-consuming and error prone task. U.S. Pat. No. 4,676,035 to GangaRao teaches an additional connection mechanism for the '606 patent. In the '035 patent, GangaRao utilizes smaller L-shaped welding bars to connect panels, resulting in less welding time and reduction in the room for error. Similar to Bloxom, Ganga Rao's panels are not easily conveyed, requiring a crane to properly move and place the panels. Finally, each of Ganga Rao's exterior panels requires a pair of reinforcing rod grids. While these grids add to the stability of the panel, they also add to the expense of the finished product.

U.S. Pat. No. 3,747,287 to Finger teaches a modular building construction method. Similar to Bloxom and Ganga Rao, Finger's panels require a crane to transport them from one spot to another (col. 7, line 15). In addition, Finger's wall panels are trapezoidal in shape, resulting in additional roofing materials and irregular wall shapes. These shapes may also be detrimental to the strength of the building to withstand external forces, such as earthquakes. This lack of strength is evidenced by the requirement of Finger to include reinforcing means on the front and back surfaces of each panel (col. 1, lines 16-18).

A structure utilizing the modules of the present invention requires little heavy machinery to assemble, thereby reducing construction costs. A structure resulting from the modules of the present invention provides superior strength than exhibited by the prior art and requires' less materials and work hours to construct.

SUMMARY

The present invention improves upon the prior art by providing a new concrete modular building system that exhibits superior strength.

One of the main objectives of the present invention is to provide houses that can withstand either vertical or lateral forces.

Another objective of the present invention is to provide an efficient and cost effective method of constructing such houses.

Another objective of the present invention is to provide modular elements that are easily transported from the manufacturing site to the construction site.

Another objective of the present invention is to provide modular elements to construct buildings without the requirement of structural beams.

These and other objectives will be described in the following detailed description of the invention, the examples and the claims.

DETAILED DESCRIPTION

Figure 1A:
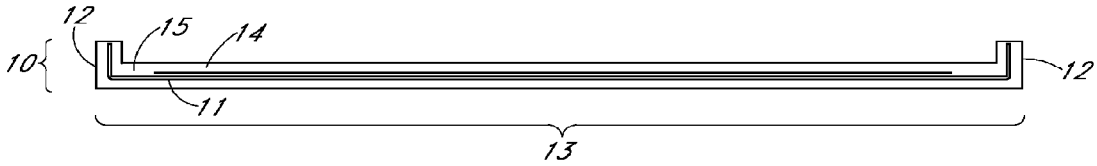
FIG. 1 provides four views (1A-1D) of one embodiment of the modules of the present invention.

The above features and advantages of the present invention will be better understood with reference to the detailed description, figures and examples. It should be understood that the particular methods and structures illustrating the present invention are exemplary only and not to be regarded as limitations of the present invention.

Throughout the specification and claims, the term "panel" means each distinct section of a wall.

Throughout the specification and claims, the term "module" means a separable component for assembly into panels.

Throughout the specification and claims, the term "fins" refers to the vertical extremities of the module that are each turned ninety degrees from the plane of the module, forming a module in the shape of "[".

Throughout the specification and claims, the term "backbone" refers to the central portion of each module without the fins.

Throughout the specification and claims, the term "structural steel mesh" refers to the structural arrangement of interlocking steel wires with spaced openings between. The term "steel" includes all generally hard, strong, durable, malleable alloys of iron and carbon, (usually containing between 0.2 and 1.5 percent carbon), often with other constituents such as manganese, chromium, nickel, molybdenum, copper, tungsten, cobalt, or silicon, depending on the desired alloy properties, and widely used as a structural material.

Throughout the specification and claims, the term "reinforcing steel mesh" refers to the second layer of interlocking steel wires connected to and used to reinforce the backbone of the module.

Throughout the specification and claims, the term "cementitious mortar" includes any of various bonding materials used in masonry, surfacing, and plastering, especially a plastic mixture of cement or lime, sand, and water that hardens in place.

Throughout the specification and claims, the term "encased" means to surround or enclose in.

Throughout the specification and claims, the term "sides" means one of the broad surfaces of a module.

Throughout the specification and claims, the term "edges" means one of the narrow surfaces of a module.

Throughout the specification and claims, the term "indentations" refers to a notch or recess in the cementitious mortar that exposes a bar of the structural steel mesh.

Throughout the specification and claims, the term "metal plate connector" refers to a flat sheet of steel welded to the exposed. structural steel mesh of adjacent modules, thereby connecting the modules.

Referring now to the drawings, wherein like reference numbers refer to like parts throughout the several views.

Figure 1B:
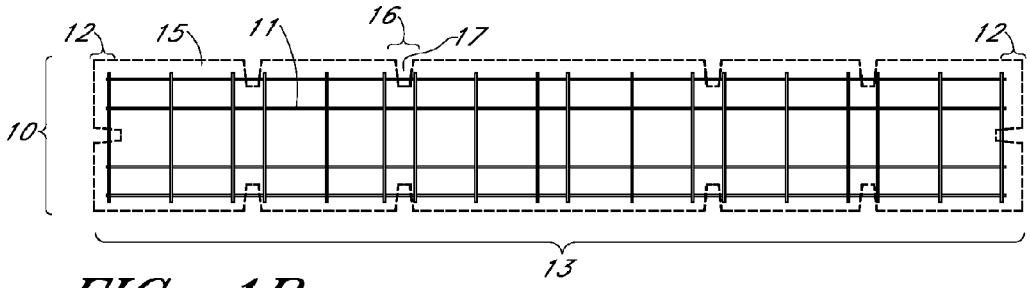
Figure 1C:
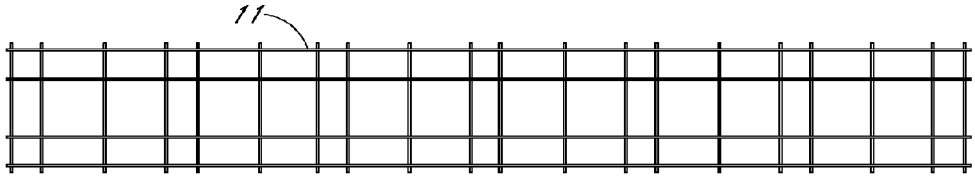
Figure 1D:
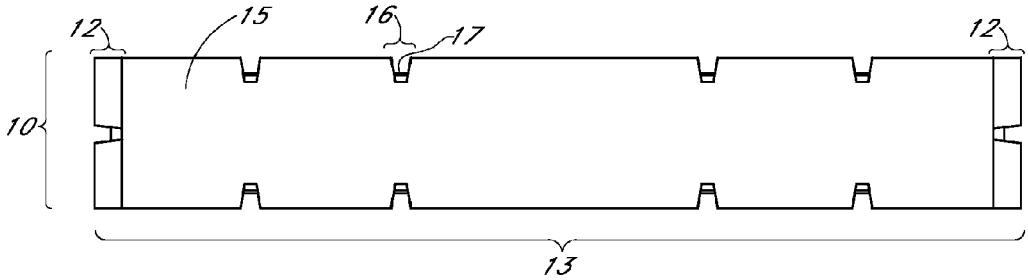
Figure 2A:
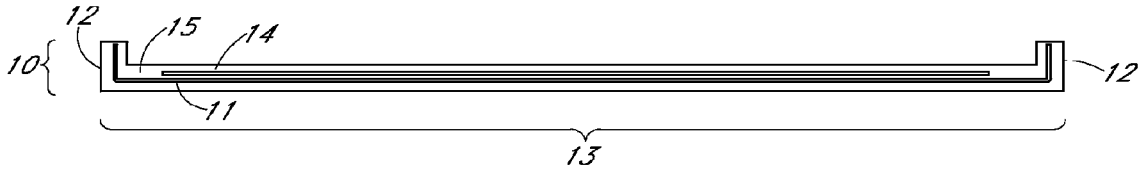
FIG. 2 provides three views (2A-2C) of a second embodiment of the modules of the present invention.
Figure 2B:
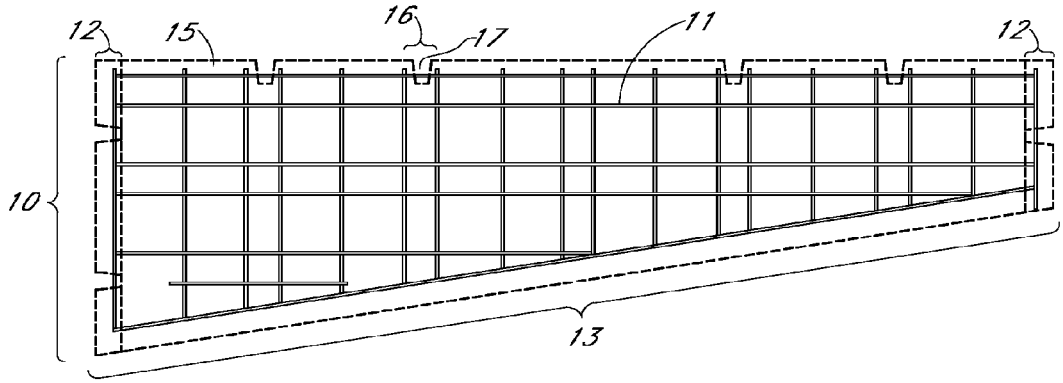
Figure 2C:
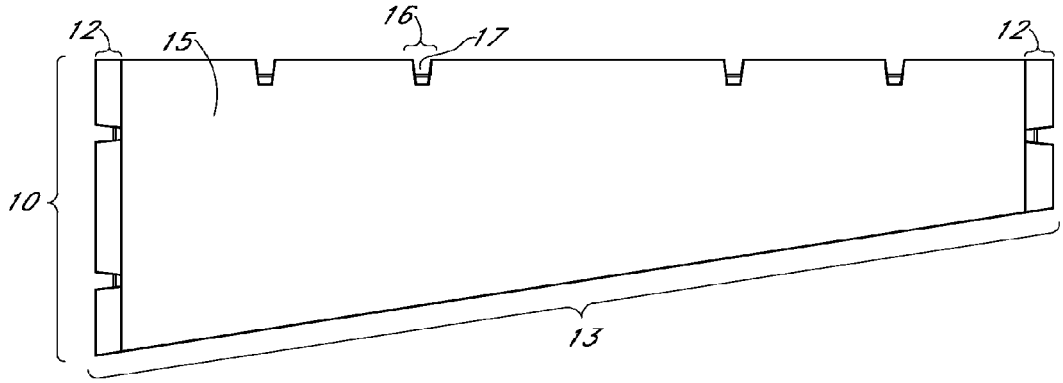

FIGS. 1B and 2B provide front views of the internal structure of two embodiments of modules of the present invention. The internal structure comprises structural steel mesh (11) that provides the desired shape of the modules (10). In FIG. 1, the module (10) is in the shape of a rectangle. In FIG. 2, the module (10) is in the shape of a trapezoid. As discussed previously, the Figures are for exemplary purposes only and the modules (10) of the present invention are not limited to the shapes of FIGS. 1 and 2.

The structural steel (11) used to form the modules (10) of the present embodiment comprise steel bars that have a yield stress ranging from 4,000 to 6,000 kg/cm$^2$. One embodiment of the present invention provides structural steel mesh (11) comprising a 4 mm diameter with spacing of 100 mm×50 mm and 100 mm×100 mm with a final module dimension of 1500 mm×250 mm. Another embodiment of the present invention provides structural steel mesh (11) comprising a 4 mm diameter with spacing of 100 mm×50 mm and 100 mm×100 mm with a final module dimension of 750 mm×250 mm. One of ordinary skill in the art would recognize that differing yield stress, diameters, spacing and module dimensions may also be used and provide the benefits of the present invention.

As evidenced in FIGS. 1A and 2A, the modules (10) are turned approximately 90° at the ends, creating fins (12). The fins (12) are used to stiffen the modules (10) in the transverse direction and also to provide stability to the modules (10) during installation. The fins (12) also make it easier to assemble the modules (10) in both the vertical and horizontal planes. The fins (12) provide strength and structural integrity thereby eliminating the need for structural beams. In one embodiment of the present invention, the fins (12) measure 50 mm from the backbone (13) of the module (10). One of ordinary skill in the art would recognize that lengths of 30 mm to 100 mm could be used in the construction of the fins (12) without departing from the teachings of the present invention.

Also evident in FIGS. 1A and 2A is the optional reinforcing steel mesh (14) of one embodiment of the present invention. The optional reinforcing steel mesh (14) can be used to add strength to the module (10). The optional reinforcing steel mesh (14) may take the form of an additional layer of structural steel mesh (11) soldered to or tied to the backbone (13) of the present invention. In this embodiment, the optional reinforcing steel mesh (14) can measure the entire length of the backbone (13) or can be composed of one or more sections that are shorter in length than the backbone (13). In a second embodiment utilizing the optional reinforcing steel mesh (14), the reinforcing steel mesh (14) may take the form of ties (not shown) at one or more intersections (23) of the structural steel in the structural steel mesh (11).

The structural steel mesh (11) used to form the modules (10) of the present invention are encased in cementitious mortar (15). The term cementitious mortar (15) includes Portland cement, water and well-graded sand with a maximum particle size of 4.8 mm. The cementitious mortar (15) of the present invention may also include the product manufactured by La Cemento Nacional Ecuador called Pegaroc. Preferably, the composition of the cementitious mortar (15) of the present invention yields the results provided in the compression and flexural tests of Examples 1 and 2. In one embodiment of the modules (10) of the present invention, the cementitious mortar (15) is approximately 40 mm thick. However, one of ordinary skill in the art would be able to practice the present invention utilizing smaller or larger degrees of thickness.

Figure 3:
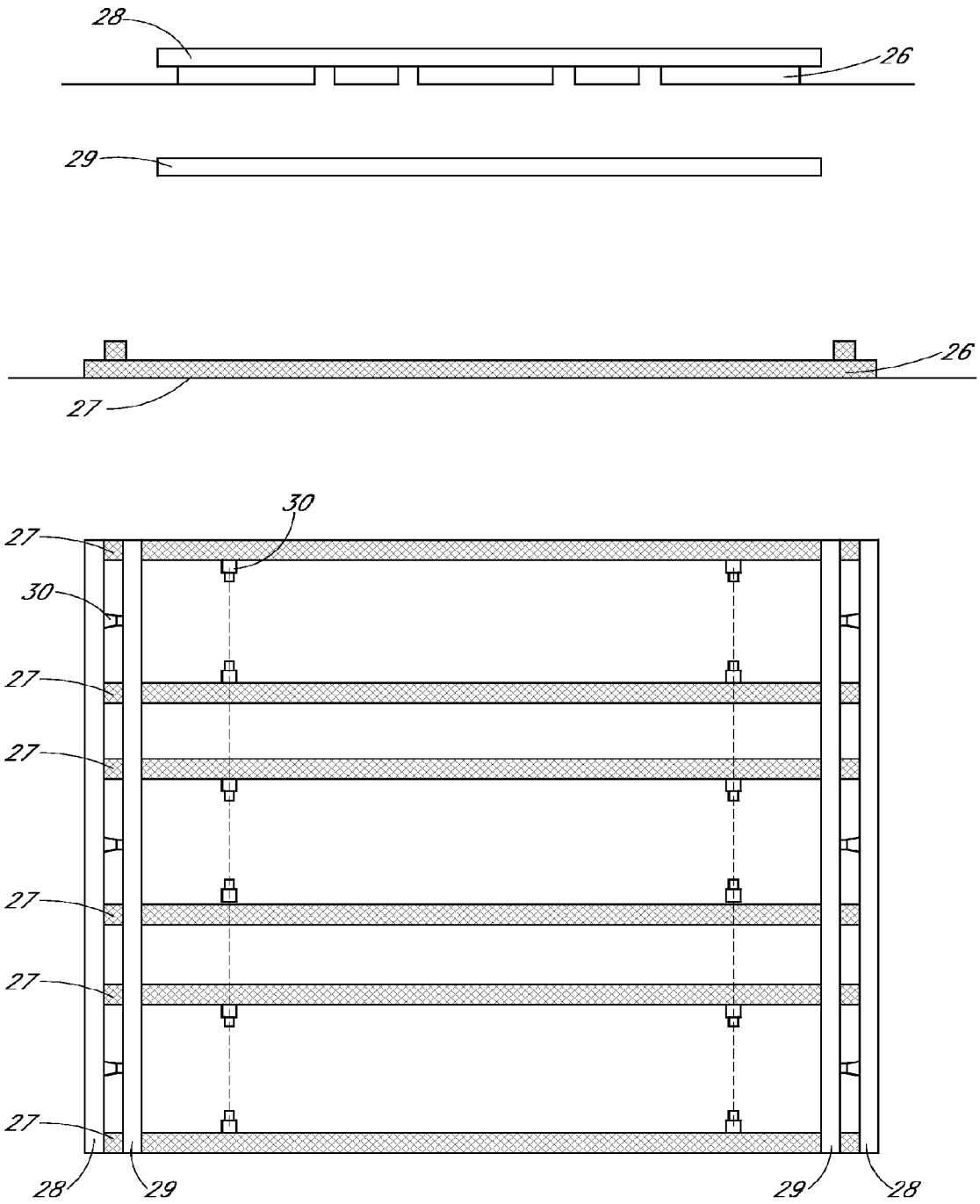
FIG. 3 provides two views of one embodiment of the molds used to create modules of the present invention.

Uniform modules (10) of the present invention are created on steel or glass tables (26) in molds (FIG. 3). The steel or glass tables (26) provide a smooth, non-stick surface on which to pour the cementitious mortar (15). One embodiment of the molds of the present invention comprises three components; the base (27), the end (28) and the fin former (29). The base (27) and end (29), as embodied in FIG. 3, both contain indentation formers (30) that create the indentations (16) in the module (10).

All materials in contact with the cementitious mortar are made of aluminum. However any material that does not stick to the cementitious mortar (15) can be used as the surface of the table (26) or molds. One embodiment of the present invention utilizes a lubricant on surfaces that contact the cementitious mortar (15). One preferred lubricant is Maxikote® 20 manufactured by Intaco. One of ordinary skill in the art would recognize that the lubricant suitable for use with the present invention will depend on the composition of the cementitious mortar (15). Therefore, the present invention is not limited to the use of Maxikote® 20.

The molds are made of components that do not stick to the cementitious mortar, allowing them to be reused to create additional and uniform modules (10). The components illustrated in FIG. 3 are exemplary: One of ordinary skill in the art would recognize that the molds can be created in alternate arrangements to create modules (10) of the desired dimensions. One of ordinary skill in the art would recognize that proper location of the indentation formers (30) is required for the construction process.

Structural steel mesh (11) is placed in the molds with the fins (12) already shaped. The structural steel mesh (11) can be bought pre-constructed or can be made of steel bars of the desired dimension. When made on site, the steel bars can be electro-soldered or tied together. If reinforcing steel mesh (14) is desired in the finished module (10) of the present invention, the structural steel mesh (11) may be purchased with the reinforcing steel mesh (14) already in place. In the alternative, the reinforcing steel mesh (14) may be tied or electro-soldered to the structural steel mesh (11) on-site. The appropriate length of the ends of the steel mesh is then bent approximately ninety degrees from the plane of the steel mesh either manually or by machine to create the fins (12).

The cementitious mortar (15) is poured into the mold, encasing the structural steel mesh (11). The cementitious mortar (15) is allowed to cure for approximately twenty-four hours. At this time, the components of the mold are removed and the modules (10) are submersed in water. The modules (10) are removed from the water after a minimum of thirty-six hours and allowed to dry. The finished module has eight edges (24) and six sides (25).

Figure 4:
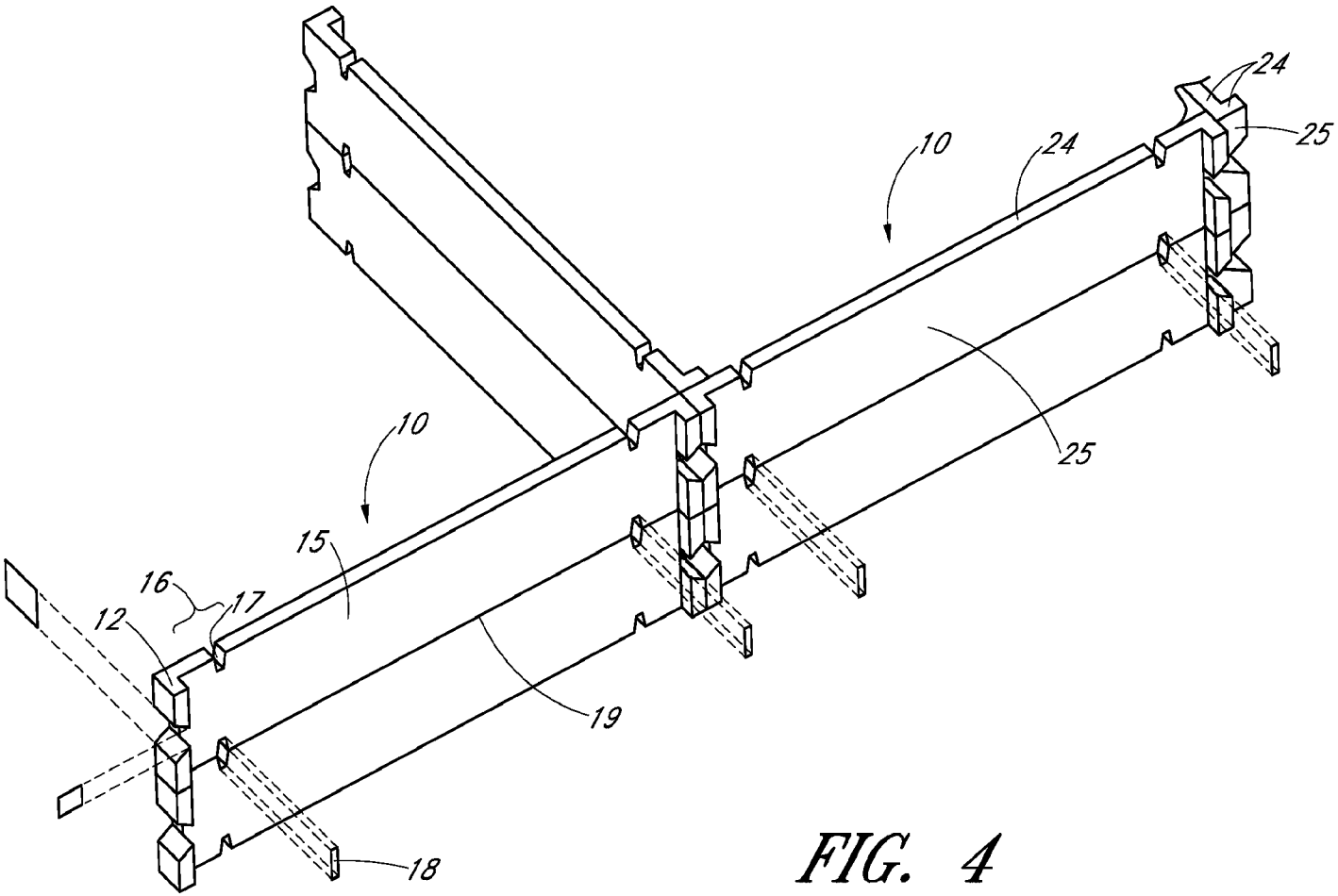
FIG. 4 provides a perspective of one embodiment of an assembly of the modules of the present invention.

During the manufacture of the modules (10) of the present invention, indentations (16) are included in the perimeter of the molds, and thereby in the edges (24) of the cementitious mortar (15), to expose the bars (17) of the structural steel mesh (11). As shown in FIGS. 1 to 4, the indentations (16) may be tapered such that each indentation (16) narrows from an edge (24) of a module (10) towards a center of a module (10). FIG. 4 shows how multiple modules (10) are connected by these indentations (16). A metal plate connector (18) is welded to the exposed bars (17) of the structural steel mesh (11) on adjacent modules (10). Cementitious mortar (15) is then placed in the voids remaining in the indentation (16). This connection mechanism provides for the transfer of normal and shear stresses, providing continuity between the modules (10) and allowing the completed structure to behave monolithically.

Another connection mechanism envisioned for the construction of the present invention utilizes a spring mechanism with hooks extending from both ends. The hooks are placed over the exposed bars (17) of the structural steel mesh (11) on adjacent modules (10). The hooks may be welded to the exposed bars (17) if desired. The spring mechanism maintains the required tension between the modules (10), while allowing the modules (10) to yield somewhat when subject to force or pressure.

Either connection mechanism provides for construction of the present invention in a more timely manner. As the structural steel mesh (11) of the modules (10) of the present invention is contained in one plane, connection of the modules (10) can be completed more rapidly than provided in the prior art.

An epoxy resin or elastomer (19) is applied to the edge (24) of the module (10) that is to be in contact with another module (10), either vertically or horizontally, to provide additional connection strength between modules (10). The epoxy resin or elastomer (19) should also exhibit suitable elasticity so that structural stresses do not cause the material to crack or break. Suitable epoxy resins or elastomers (19) include Juntacril, manufactured by Adatec, and Maxiflex, manufactured by Intaco. One or ordinary skill in the art would recognize that other bonding materials may be used in place of the epoxy resin or elastomer (19). Care should be taken in choosing a long lasting and environmentally safe bonding material.

The modules (10) of the present invention can be used in the manufacture of housing or similar structures. A foundation is created in known fashion. For example, the land on which the structure is to be built is prepared and compacted. A base slab or platform is made of concrete reinforced with steel mesh. Indentations are created in the base slab or platform that coincide with the indentations (16) in the modules (10), thus permitting attachment of the modules (16) to the base slab or platform. Each module (10) of the first row of modules is connected to the base slab or platform by a metal plate connector (18) inserted between the indentations (16) of the module and the indentation of the base slab or platform. In an alternative embodiment, the metal plate connector (18) can be replaced by a spring mechanism with hooks extending from both ends; as previously described. The metal plate connector (18) is welded to the exposed bars (17) of the structural steel mesh. Cementitious mortar (15) is then used to fill in the voids remaining in the indentation (16) and to provide a uniform interior and exterior surface. Additional rows of modules (10) are added to first row as previously described. One of ordinary skill in the art would recognize that the size of modules (10) can vary, as long as the indentations (16) are aligned to permit the joinder of adjacent modules. (10). The number of rows of modules required will depend on the desired height of the structure. Finally, any conventional roof can be used after the desired structure height is reached.

The present invention was subjected to laboratory tests conducted at the Structural Laboratory of the School of Engineering of Universidad Catolica de Guayaquil-Ecuador. The tests were performed on the cementitious mortar used to form the modules, the individual modules of the proposed system and on a real scale-housing unit constructed specifically for these tests. All testing procedures were carried out according to the American Standard of Testing Materials (ASTM). The results show that the materials behaved according to the specifications and limits set by ASTM specifications and regulations.

Example 1

A housing unit was created to test the natural period of the unit using ambient vibration measurements. The housing unit measured three meters on each side, contained two levels, a slab and a light roof, all constructed of modules of the present invention. The ambient earth waves incident to the structure were measured two times, for a duration of 150 seconds each. The ambient vibration frequency recorded in the North-South direction averaged 5.5 Hz. The ambient vibration frequency recorded in the East-West direction averaged 10 Hz. These results indicate that the structure is very sturdy.

Example 2

Figure 5:
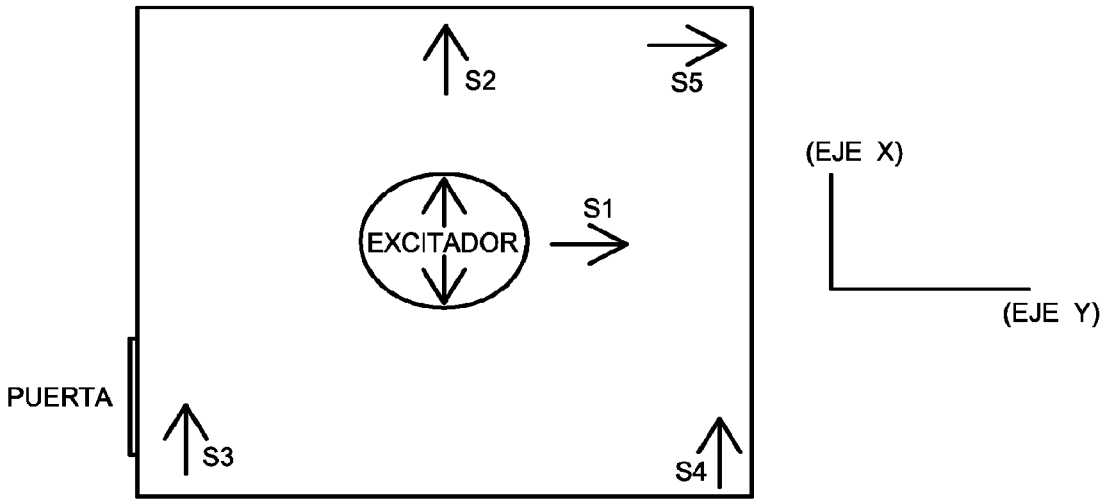
FIG. 5 provides a visual depiction of the forced vibration test applied to a two-story structure manufactured from modules of the present invention.

The forced vibration test consists of the application of a dynamic force of a sinusoidal shape to the top of the structure. The forced vibration test allows the determination of dynamic parameters, such as vibrations, critical damping, real acceleration, mode shapes, etc. that are obtained in response to a dynamic force. The test begins with a known range of frequencies (Hertz or Hz). The range of frequencies is changed from a lesser to a larger value in a procedure known as a frequency sweep. The effect of the frequencies is measured at various locations as depicted in FIG. 5. An analysis of the results indicate that the structure is capable of withstanding an earthquake measuring 7.1 on the Richter scale.

While the invention has been described with respect to preferred embodiments, it will be understood by those skilled in the art that various changes in detail may be made therein without departing from the spirit, scope, and teaching of the invention

What is claimed is:

1. A modular building system comprising:

multiple portable pre-cast modules, wherein each of the multiple modules comprises:

a structural steel mesh defining a C-shaped or square-bracket shaped cross-section;

a cementitious mortar encasing the structural steel mesh so as to define a monolithic module body having a plurality of spaced-apart recesses located along one or more edges of the module body, the structural steel mesh comprising one or more elongated bars that extend generally parallel to and inward from said one or more edges, the elongated bar having at least an encased portion that is encased in the cementitious mortar that defines the monolithic module body and at least an exposed portion that is exposed and traverses said recesses from one edge of the recess to another edge of the recess, the module body having a generally planar wall portion that extends substantially along a first plane, the module body having a pair of fins on proximal and distal ends of the wall portion, each of the fins extending generally perpendicular to, and outward from, the wall portion along a second plane generally perpendicular to the first plane such that the module body has a C-shaped or square-bracket shaped cross-section along a third plane perpendicular to the first and second planes corresponding to the shape of the structural steel mesh; and one or more connectors, said connectors configured for insertion between aligned recesses of adjacent modules and configured to be coupled to the exposed portion of the one or more elongated bars in said aligned recesses to fixedly couple the adjacent modules when the modules are placed in contact with each other along at least one of their respective edges so that the recesses on said edges align with each other and the modules are in contact with each other.

2. The modular building system of claim 1, wherein the one or more connectors are metal plate connectors, and wherein the metal plate connectors are configured to be welded to the exposed portion of the one or more elongated bars in said aligned recesses to fixedly couple the adjacent modules together.

3. The modular building system of claim 1, wherein the generally planar wall portion has shape chosen from the group consisting of: a square, a rectangle, and a trapezoid.

4. The modular building system of claim 1, wherein the structural steel mesh is embedded in the wall portion and the fins such that at least a portion of the structural steel mesh defines a C-shaped or square bracket shaped cross-section.

5. The modular building system of claim 1, wherein when stacked on top of each other so that the wall portions of the multiple modules define a plane, the fins on each of the proximal and distal ends of the wall portions align with each other and extend perpendicular and outward from said plane.

6. The modular building system of claim 1, wherein one or more of the plurality of spaced-apart recesses is tapered so that the recess narrows from an edge of the module toward the center of the module.

7. A modular building system, comprising:

one or more portable pre-cast modules, wherein each of the modules comprises a structural steel mesh defining a C-shaped or square-bracket shaped cross-section, and a cementitious mortar encasing the structural steel mesh so as to define a monolithic module body having a generally planar wall portion that extends along a first plane between a proximal edge and a distal edge and between a left-side edge and a right-side edge, the module body having a plurality of spaced-apart recesses located along the left-side edge, right-side edge and one or both of the proximal and distal edges of the wall portion, the recesses extending across a thickness of the wall portion, the structural steel mesh comprising one or more elongated bars, each of the one or more elongated bars having at least an encased portion that is encased in the cementitious mortar that defines the monolithic module body and at least an exposed portion that is exposed within said recesses and traverses said recesses from one edge of the recess to an opposite edge of the recess, each of said recesses configured to align with a recess in a second module body placed in direct contact with the module body along at least one of their respective edges, the aligned recesses defining an aperture between said modules configured to receive a connector coupleable to the exposed portion of the elongated bar in the aligned recesses so as to fixedly couple the module bodies together, wherein the module body has a pair of fins on proximal and distal ends of the generally planar wall portion, each of the fins extending generally perpendicular to, and outward from, the wall portion along a second plane generally perpendicular to the first plane such that the module body has a C-shaped or square-bracket shaped cross-section along a third plane perpendicular to the first and second planes corresponding to the shape of the structural steel mesh.

8. The modular building system of claim 7, wherein the exposed portion of the one or more elongated bars traverses the recess generally parallel to the edge of the module body proximate the recess, and inwardly from said edge.

9. The modular building system of claim 7, wherein the one or more connectors are metal plate connectors, and wherein the metal plate connectors are configured to be welded to the exposed portion of the one or more elongated bars in said aligned recesses to fixedly couple the adjacent modules together.

10. The modular building system of claim 7, wherein the generally planar wall portion has shape chosen from the group consisting of: a square, a rectangle, and a trapezoid.

11. The modular building system of claim 7, wherein the structural steel mesh is embedded in the wall portion and the fins such that at least a portion of the structural steel mesh defines a C-shaped or square bracket shaped cross-section.

12. The modular building system of claim 7, wherein one or more of the plurality of spaced-apart recesses is tapered so that the recess narrows from an edge of the module toward the center of the module.

* * * * *